US009817366B2

(12) United States Patent
Katsumata et al.

(10) Patent No.: US 9,817,366 B2
(45) Date of Patent: Nov. 14, 2017

(54) IMAGE FORMING APPARATUS AND CHARGING DEVICE

(71) Applicant: Konica Minolta, Inc., Tokyo (JP)

(72) Inventors: Keiki Katsumata, Tokyo (JP); Yuichi Omori, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/635,373

(22) Filed: Mar. 2, 2015

(65) Prior Publication Data

US 2015/0261182 A1 Sep. 17, 2015

(30) Foreign Application Priority Data

Mar. 12, 2014 (JP) ..... 2014-048756

(51) Int. Cl.
*G03G 21/20* (2006.01)
*G03G 15/02* (2006.01)

(52) U.S. Cl.
CPC ..... *G03G 21/206* (2013.01); *G03G 15/02* (2013.01); *G03G 15/0258* (2013.01)

(58) Field of Classification Search
USPC ..... 399/92
See application file for complete search history.

(56) References Cited

U.S. PATENT DOCUMENTS 8,498,548 B2 * 7/2013 Nishikawa ..... G03G 21/206 399/92
2005/0202773 A1 * 9/2005 Arold ..... B60H 1/3407 454/69
2013/0108307 A1 * 5/2013 Katahira ..... G03G 21/206 399/92

FOREIGN PATENT DOCUMENTS

| | | | |
|---|---|---|---|
| CN | 103186068 | A | 7/2013 |
| JP | H0915945 | A | 1/1997 |
| JP | 10-198128 | A | 7/1998 |
| JP | 2002365987 | A | 12/2002 |
| JP | 2007140265 | A | 6/2007 |
| JP | 2008-076777 | A | 4/2008 |
| JP | 2012-198490 | A | 10/2012 |

OTHER PUBLICATIONS

JP2012-198490 English Machine Translation, available from JPO website, retrieved Jan. 8, 2016.*
JP09-015945 English machine translation retrieved from JPO website.*

(Continued)

*Primary Examiner* — Minh Phan
(74) *Attorney, Agent, or Firm* — Lucas & Mercanti, LLP

(57) ABSTRACT

An image forming apparatus includes: a charging section configured to charge a surface of an image bearing member; an air-intake duct having an air-supply port, and configured to guide air sucked from an outside to the charging section through the air-supply port; an exhaust duct having an air-intake port, and configured to suck air around the charging section through the air-intake port and eject the air thus sucked. The air-intake duct has a configuration in which air guided to the charging section through the air-supply port flows in a direction orthogonal to a longitudinal direction of the charging section, or flows toward a center of the charging section in the longitudinal direction.

8 Claims, 9 Drawing Sheets

(56) References Cited

OTHER PUBLICATIONS

Notice of Reasons for Rejection; Patent Application No. 2014-048756; Dispatch Date: Mar. 29, 2016; Drafting Date: Mar. 25, 2016; English translation of Notice of Reasons for Rejection; total of 13 pages.

The State Intellectual Property Office of the People's Republic of China, First Office Action dated Dec. 26, 2016 including English translation thereof.

* cited by examiner

IMAGE FORMING APPARATUS AND CHARGING DEVICE

CROSS REFERENCE TO RELATED APPLICATIONS

This application is entitled and claims the benefit of Japanese Patent Application No. 2014-048756, filed on Mar. 12, 2014, the disclosure of which including the specification, drawings and abstract is incorporated herein by reference in its entirety.

BACKGROUND OF THE INVENTION

1. Field of the Invention

The present invention relates to an electrophotographic image forming apparatus and a charging device.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to a sheet, followed by heating and pressurization, whereby an image is formed on the sheet.

In the above-mentioned image forming apparatus, when the surface of the photoconductor is uniformly charged by a charger, products called discharge products such as ozone and nitrogen oxide are generated by the electrostatic discharge of the charger. The discharge products such as ozone and nitrogen oxide attach to the surface of the photoconductor, and bind to water molecules in the atmosphere. Consequently, the electric resistance on the surface of the photoconductor is reduced, and image defect (image flow) may be caused.

Under such a circumstance, to prevent image flow from occurring, a technique of outputting discharge products floating around a charger has been proposed.

Japanese Patent Application Laid-Open No. 2012-198490 discloses an image forming apparatus including: jetting means for jetting gas toward a charging section that charges a photoconductor or toward a region around the charging section; and sucking means for sucking gas including the gas jetted by the jetting means around the charging section.

Japanese Patent Application Laid-Open No. 2008-76777 discloses an image forming apparatus including: an air-intake duct that guides gas to the inside of a charger; an air-intake fan that sends the gas from the outside to the air-intake duct; an exhaust duct for outputting gas from the inside of the charger; and an exhaust fan that sends to the outside the gas from the exhaust duct, in which the velocity of air in the air-intake duct resulting from the operation of the air-intake fan is greater than the velocity of air in the exhaust duct resulting from the operation of the exhaust fan.

Japanese Patent Application Laid-Open No. 10-198128 discloses a corona discharging device including: a shield case that covers an electrostatic discharge wire for corona discharging to a charge target, and has an air-blowout port opened along the electrostatic discharge wire; an air duct that connects the air-blowout port with the outside of the apparatus housing; and an air blow fan that blows the air on the outside of the apparatus housing into the shield case through the air duct and the air-blowout port. In the technique disclosed in Japanese Patent Application Laid-Open No. 10-198128, a partition wall is uprightly provided along the longitudinal direction of the shield case in the air duct, thereby temporarily increasing the pressure of the air flow sent toward the shield case on the near side of the partition wall. In this manner, the air flow is uniformized along the longitudinal direction of the shield case when it passes over the partition wall, and is thus uniformly blown into the shield case.

However, in the techniques disclosed in Japanese Patent Application Laid-Open Nos. 2012-198490 and 2008-76777, the direction of the air flow toward the charging section may become inconsistent when discharge products are output by gas (air). When such inconsistency of the direction of the air flow is caused, the air containing discharge products does not smoothly flow toward the exhaust duct, and as a result, some of the discharge products are not output. Consequently, image flow cannot be sufficiently prevented.

On the other hand, in the technique disclosed in Japanese Patent Application Laid-Open No. 10-198128, since an air flow is uniformly blown to the air-blowout port, an air flow can be uniformly blown along the direction in which the electrostatic discharge wire is provided. However, at the position where the partition wall is uprightly provided, the area of the air-sending port is small and the pressure loss (ventilation resistance) of the air flowing through the inside of the duct is undesirably large. Thus, the volume (air velocity) of the air blown to the electrostatic discharge wire is small, and the performance for outputting discharge products cannot be sufficiently ensured.

SUMMARY OF THE INVENTION

An object of the present invention is to provide an image forming apparatus and a charging device which can surely prevent image flow from occurring.

To achieve the abovementioned object, an image forming apparatus reflecting one aspect of the present invention includes a charging section configured to charge a surface of an image bearing member; an air-intake duct having an air-supply port, and configured to guide air sucked from an outside to the charging section through the air-supply port; an exhaust duct having an air-intake port, and configured to suck air around the charging section through the air-intake port and eject the air thus sucked, wherein the air-intake duct has a configuration in which air guided to the charging section through the air-supply port flows in a direction orthogonal to a longitudinal direction of the charging section, or flows toward a center of the charging section in the longitudinal direction.

Desirably, in the image forming apparatus, in the longitudinal direction of the charging section, the air-intake duct has a width that gradually increases toward the charging section side, the air-supply port is provided along the longitudinal direction of the charging section, and, in the longitudinal direction of the charging section, both end portions of the air-supply port each have a cross-sectional area smaller than that of another portion of the air-supply port.

Desirably, in the image forming apparatus, a plurality of the air-supply ports are provided along the longitudinal direction of the charging section, and, of the air-supply ports, air-supply ports provided on both sides in the longitudinal direction of the charging section each have a cross-sectional area smaller than that of each air-supply port provided in a region other than the both sides.

Desirably, in the image forming apparatus the air-intake duct is provided with a flow adjusting member configured to adjust air sucked from an outside such that the air expands toward both sides in the longitudinal direction of the charging section.

Desirably, in the image forming apparatus the air-intake duct includes two air-intake fans provided on both sides in the longitudinal direction of the charging section.

A charging device reflecting another aspect of the present invention includes: a charging section configured to charge a surface of an image bearing member; an air-intake duct having an air-supply port, and configured to guide air sucked from an outside to the charging section through the air-supply port; an exhaust duct having an air-intake port, and configured to suck air around the charging section through the air-intake port and eject the air thus sucked, wherein the air-intake duct has a configuration in which air guided to the charging section through the air-supply port flows in a direction orthogonal to a longitudinal direction of the charging section, or flows toward a center of the charging section in the longitudinal direction.

Desirably, in the charging device, in the longitudinal direction of the charging section, the air-intake duct has a width that gradually increases toward the charging section side, the air-supply port is provided along the longitudinal direction of the charging section, and, in the longitudinal direction of the charging section, both end portions of the air-supply port each have a cross-sectional area smaller than that of another portion of the air-supply port.

Desirably, in the charging device, a plurality of the air-supply ports are provided along the longitudinal direction of the charging section, and, of the air-supply ports, air-supply ports provided on both sides in the longitudinal direction of the charging section each have a cross-sectional area smaller than that of each air-supply port provided in a region other than the both sides.

Desirably, in the charging device, the air-intake duct is provided with a flow adjusting member configured to adjust air sucked from an outside such that the air expands toward both sides in the longitudinal direction of the charging section.

Desirably, in the charging device, the air-intake duct includes two air-intake fans provided on both sides in the longitudinal direction of the charging section.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, an embodiment is described in detail with reference to the drawings.

[Configuration of Image Forming Apparatus 1]

Figure 1:
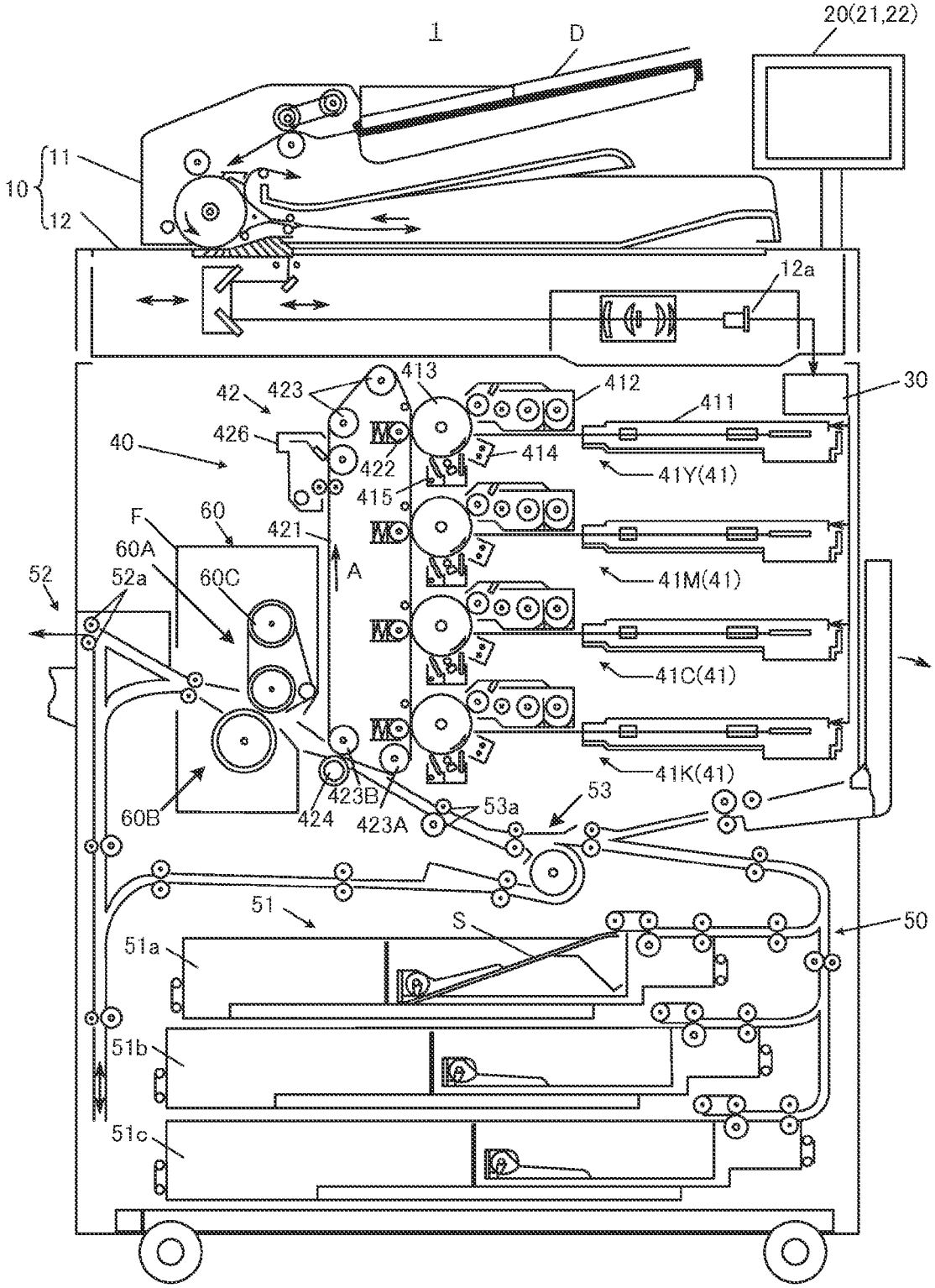
FIG. 1 illustrates a general configuration of an image forming apparatus of a present embodiment.
Figure 2:
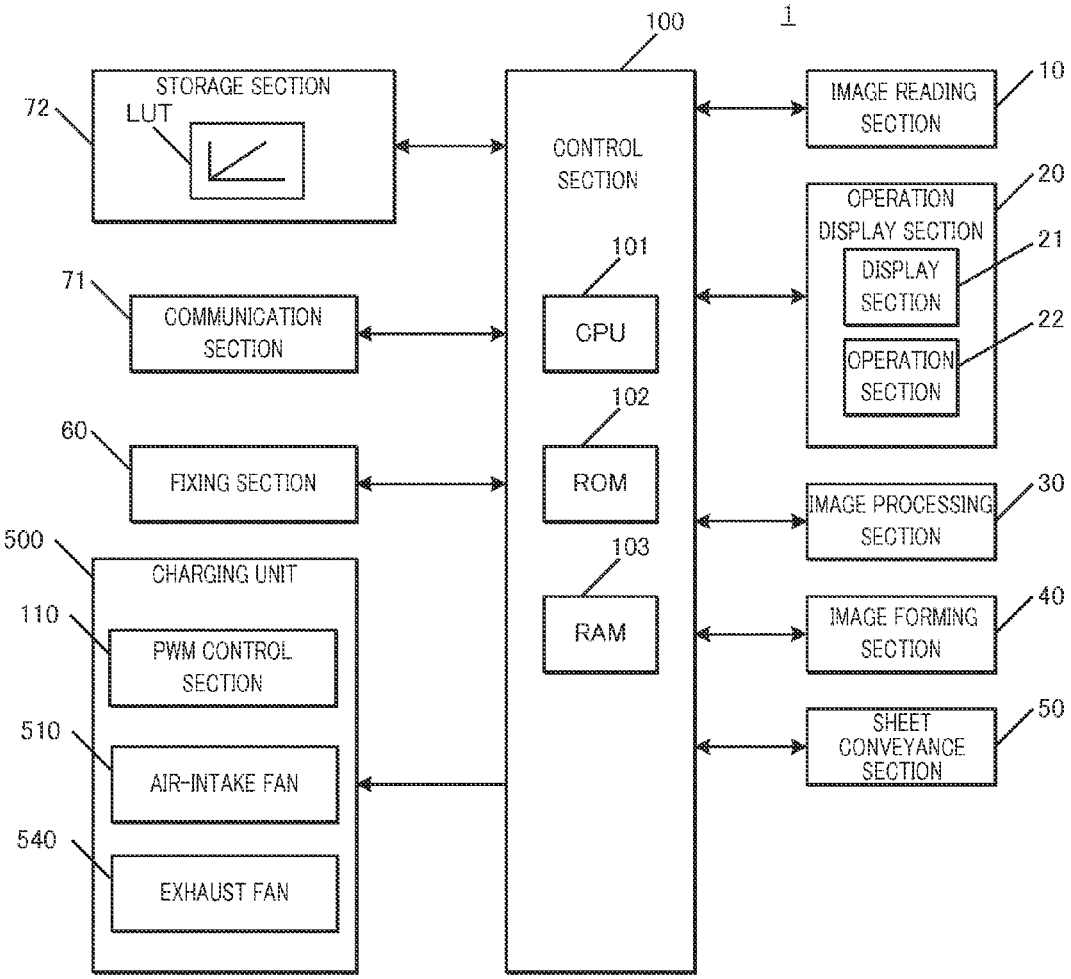
FIG. 2 illustrates a principal part of a control system of the image forming apparatus of the present embodiment.

FIG. 1 illustrates an overall configuration of image forming apparatus 1 according to the embodiment of the present invention. FIG. 2 illustrates a principal part of a control system of image forming apparatus 1 according to the embodiment. Image forming apparatus 1 illustrated in FIGS. 1 and 2 is a color image forming apparatus of an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to sheet S, to thereby form an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 1 includes image reading section 10, operation display section 20, image processing section 30, image forming section 40, sheet conveyance section 50, fixing section 60, and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanner (scanner) 12, and the like.

Auto document feeder 11 causes a conveyance mechanism to feed document D placed on a document tray, and sends out document D to document image scanner 12. Auto document feeder 11 enables images (even both sides thereof)

of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

Image processing section 30 includes a circuit that performs digital image processing suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K for images of colored toners respectively containing a Y component, an M component, a C component, and a K component on the basis of the input image data; intermediate transfer unit 42; and the like.

Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415 and the like.

Photoconductor drums 413 are, for example, negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm] The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. Since the positive charge is generated in the charge generation layer of photoconductor drum 413 and is transported to the surface of the charge transport layer, the surface charge (negative charge) of photoconductor drum 413 is neutralized. An electrostatic latent image of each color component is formed on the surface of photoconductor drum 413 by the potential difference from its surroundings.

Developing device 412 is, for example, a two-component development type developing device, and attaches the toners of respective color components to the surface of photoconductor drums 413 to visualize the electrostatic latent image, thereby forming a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face roller 423B (hereinafter referred to as "backup roller 423B") disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and electric charge of the polarity opposite to the polarity of the toner is applied to the rear side (the side that makes contact with secondary transfer roller 424) of sheet S, whereby the toner image is electrostatically transferred to sheet S. Sheet S on which the toner images have been transferred is conveyed toward fixing section 60.

Belt cleaning device 426 includes a belt cleaning blade that is brought into sliding contact with the surface of intermediate transfer belt 421, and removes residual toner that remains on the surface of intermediate transfer belt 421 after the secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) side of sheet S, lower fixing section 60B having a back side supporting member disposed on the rear surface (the surface opposite to the fixing surface) side of sheet S, heating source 60C, and the like. Back side supporting member is brought into pressure contact with the fixing side member, whereby a fixing nip for conveying sheet S in a tightly sandwiching manner is formed.

Fixing section 60 applies, at the fixing nip, heat and pressure to sheet S on which a toner image has been secondary-transferred, thereby fixing the toner image on sheet S. Fixing section 60 is disposed as a unit in fixing part F. In addition, fixing part F may be provided with an air-separating unit that blows air to separate sheet S from the fixing side member or the back side supporting member. Fixing section 60 will be described in detail later.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of pairs of conveyance rollers such as a pair of registration rollers 53*a*.

The recording sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet discharging rollers 52*a*.

[Configuration of Image Forming Unit 41]

Figure 3:
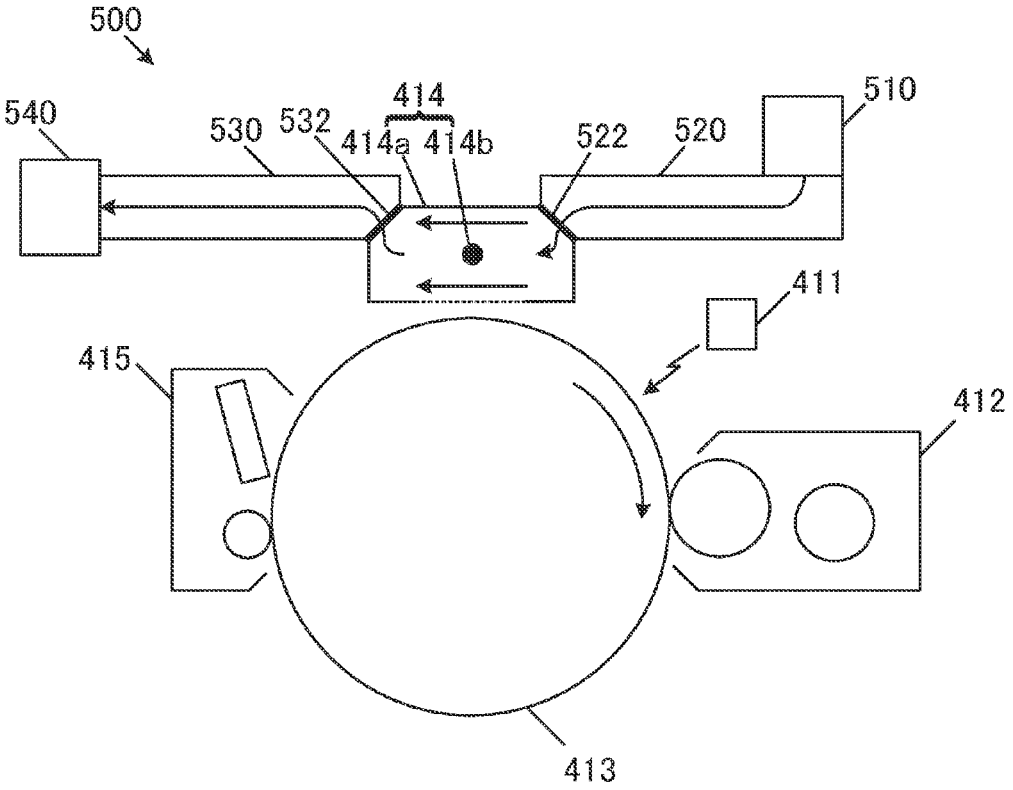
FIG. 3 illustrates a configuration of an image forming unit of the present embodiment.

Next, with reference to FIG. 3, a configuration of image forming unit 41 will be described. In FIG. 3, along the rotational direction (arrow direction) of photoconductor drum 413 (image bearing member), charging unit 500 that includes charging device 414, exposing device 411, developing device 412, and drum cleaning device 415 that removes toner remaining on photoconductor drum 413 are provided.

Charging unit 500 includes PWM control section 110 (see FIG. 2), air-intake fan 510 (air inlet part), air-intake duct 520, exhaust duct 530, and exhaust fan 540 (exhaust part), in addition to charging device 414.

Charging device 414 includes frame body 414*a*, and strip electrode 414*b* (charging section) provided in frame body 414*a* at a position near the outer peripheral surface of photoconductor drum 413. Strip electrode 414*b* is connected with a power source section not illustrated, and is configured to discharge electricity to the outer peripheral surface of photoconductor drum 413 with the power supplied from the power source section so as to charge photoconductor drum 413. One strip electrode 414*b* may be used to charge photoconductor drum 413, or a plurality of strip electrodes 414*b* may also be used to charge photoconductor drum 413.

Charging device 414 is extended along the width direction (axial direction of photoconductor drum 413) of photoconductor drum 413. Further, charging device 414 is so provided as to sufficiently cover the width of photoconductor drum 413. That is, charging device 414 is so provided as to be able to charge the entirety of the outer peripheral surface of photoconductor drum 413, in the width direction of photoconductor drum 413.

The space on the right side of strip electrode 414*b* in frame body 414*a* is connected with the internal space of air-intake duct 520 through air-supply ports 522 provided in air-intake duct 520. In addition, the space on the left side of strip electrode 414*b* in frame body 414*a* is connected with the internal space of exhaust duct 530 through air-intake port 532 provided in exhaust duct 530.

Air-intake duct 520 connects air-supply ports 522 with the ejection port of air-intake fan 510. Air-intake duct 520 is a cylindrical member made of a resin material for example. The connection path of air-intake duct 520 has a sealing property that prevents air leak resulting from the jet stream from air-intake fan 510.

Under the control of control section 100, air-intake fan 510 injects air to the space on the right side of strip electrode 414*b* through air-intake duct 520 and air-supply ports 522. To be more specific, air-intake fan 510 is a sirocco fan or an axial flow fan disposed on the upper side of air-intake duct 520, for example. Air-intake fan 510 sucks air from the air-supply port with the rotation of a vane, and outputs the sucked air toward the bottom surface of air-intake duct 520 from the ejection port. The air output toward the bottom surface of air-intake duct 520 passes through air-intake duct 520, and is injected to the inside of frame body 414*a* from air-supply ports 522. The air injected from air-supply ports 522 passes through the space near strip electrode 414*b* from air-intake duct 520 side, and flows toward exhaust duct 530. At this time, by the electrostatic discharge of strip electrode 414*b*, the air injected from air-supply ports 522 sweeps the discharge products such as ozone generated in the space near strip electrode 414*b*, toward exhaust duct 530.

In exhaust duct 530, air-intake port 532 is provided at a position that faces strip electrode 414*b* in a direction orthogonal to the longitudinal direction of strip electrode 414*b* (which corresponds to the axial direction of photoconductor drum 413). Exhaust duct 530 connects air-intake port 532 with the suction port of exhaust fan 540. Exhaust duct 530 is a cylindrical member made of a resin material for example. Exhaust duct 530 has a sealing property that prevents air leak resulting from the jet stream from air-intake fan 510.

Through exhaust duct 530 and air-intake port 532, exhaust fan 540 sucks air from the side of strip electrode 414*b* opposite to the side of strip electrode 414*b* to which air is injected by air-intake fan 510. To be more specific, exhaust fan 540 is a sirocco fan or an axial flow fan for example. Under the control of control section 100, exhaust fan 540 sucks air from the suction port with the rotation of a vane, and outputs the sucked air from the exhaust port. By sucking air from the suction port, exhaust fan 540 sucks air from air-intake port 532 through exhaust duct 530. At this time, the air, which has been injected from air-supply ports 522, has passed through the space near strip electrode 414*b* from air-intake duct 520 side, and has swept the discharge products generated in the space near strip electrode 414*b* by the electrostatic discharge of strip electrode 414*b*, exists at a position near air-intake port 532. That is, exhaust fan 540 sucks air containing the discharge products generated in the space near strip electrode 414*b* from air-intake port 532 of exhaust duct 530.

An ozone filter not illustrated is provided in the air path between the exhaust port of exhaust fan 540 and the outside of image forming apparatus 1. The ozone filter is, for example, a filter having a layer including a predetermined catalyst (for example, active carbon and the like) through which air passes in the path of the air, and removes ozone (discharge products) from the air by the action of the catalyst.

Control section 100 controls the operations of air-intake fan 510 and exhaust fan 540 through PWM control section 110. To be more specific, when operating air-intake fan 510 and exhaust fan 540, control section 100 controls PWM control section 110 to apply, to air-intake fan 510 and exhaust fan 540, a predetermined voltage for operating each of air-intake fan 510 and exhaust fan 540. Air-intake fan 510 and exhaust fan 540 rotate respective vanes in accordance with the value of the voltage from PWM control section 110, so as to perform the injection and suction in the above-mentioned manner.

When a power switch (not illustrated) of image forming apparatus 1 is turned on, control section 100 controls each section of image forming apparatus 1 so as to establish a state (standby state) for starting image formation. At this time, control section 100 controls exhaust fan 540 to operate at a predetermined low rotational speed (small air volume). In addition, at the time of image formation of image forming apparatus 1, control section 100 controls air-intake fan 510 to operate, before controlling the power source section to supply power to strip electrode 414*b*. In addition, control section 100 controls air-intake fan 510 to operate, and controls exhaust fan 540 to operate at a predetermined high rotational speed (high air volume). After air-intake fan 510 starts to operate and exhaust fan 540 starts to operate at a predetermined high rotational speed, control section 100 controls each section of image forming apparatus 1 to perform the operations for image formation, which include the control of the power source section to supply power to strip electrode 414*b*.

After the image formation of image forming apparatus 1 is completed, control section 100 controls air-intake fan 510 to operate, and controls exhaust fan 540 to operate at a predetermined high rotational speed until a predetermined time elapses from the completion of the image formation. After a predetermined time has elapsed from the completion of the image formation, control section 100 stops air-intake fan 510, and controls exhaust fan 540 to operate at a predetermined low rotational speed. Thereafter, until image formation of image forming apparatus 1 is again performed, or until the power switch of image forming apparatus 1 is turned off, control section 100 keeps the state where air-intake fan 510 is stopped and the exhaust fan 540 operates at a predetermined low rotational speed. When image formation is again performed, control section 100 controls air-intake fan 510 to operate and controls exhaust fan 540 to operate at a predetermined high rotational speed in the above-mentioned manner. When the power switch of image forming apparatus 1 is turned off, exhaust fan 540 is stopped.

Figure 4:
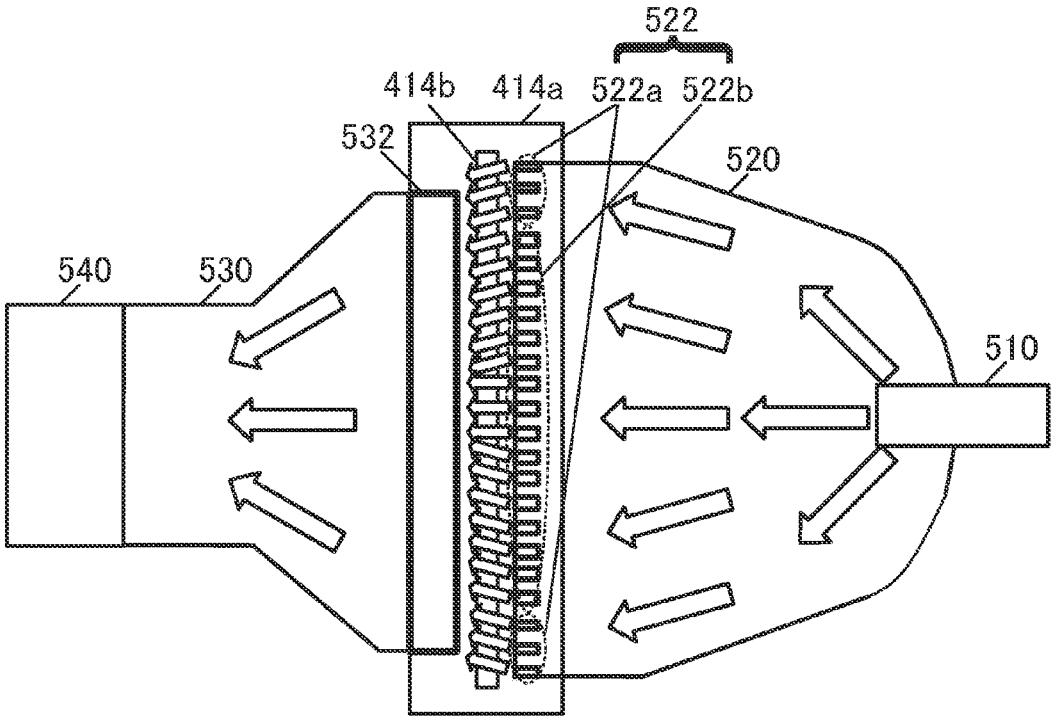
FIG. 4 illustrates a configuration of a charging unit of the present embodiment.

FIG. 4 illustrates charging unit 500 of FIG. 3 as viewed from the upper side. As illustrated in FIG. 4, air-intake duct 520 is formed in a flaring shape whose width gradually increases from air-intake fan 510 side toward strip electrode 414*b* side. At the end portion of air-intake duct 520 on strip electrode 414*b* side, a plurality of slit-shaped air-supply ports 522 are provided along the longitudinal direction of strip electrode 414*b* (vertical direction in FIG. 4). Of air-supply ports 522, air-supply ports 522*a* provided on the both end sides in the longitudinal direction of strip electrode 414*b* each have a cross-sectional area smaller than that of each air-supply port 522*b* provided in regions other than the both end sides.

In addition, as illustrated in FIG. 4, exhaust duct 530 is formed in a tapered shape whose width gradually decreases from strip electrode 414*b* side toward exhaust fan 540 side. At the end portion of exhaust duct 530 on strip electrode 414*b* side, air-intake port 532 having a rectangular shape is provided. The width of the end portion of exhaust duct 530 on strip electrode 414*b* side (that is, the width of air-intake port 532) is smaller than the width of the end portion of air-intake duct 520 on strip electrode 414*b* side. By setting the width of air-intake port 532 to a small width so as to obtain a strong suction force of exhaust fan 540, it is possible to enhance the efficiency of outputting the air containing the discharge products generated by the electrostatic discharge of strip electrode 414*b*. It should be noted that, when exhaust fan 540 has a sufficient exhaust capacity, the width of air-intake port 532 may be greater than the width of the end portion of air-intake duct 520 on strip electrode 414*b* side.

As shown by the arrows in the drawing, the air output from air-intake fan 510 toward the bottom surface of air-intake duct 520 hits the bottom surface of air-intake duct 520, expands in the width direction of air-intake duct 520, and flows toward air-supply ports 522. Of the air flowing in air-intake duct 520, the air flowing along the wall of air-intake duct 520 (that is, the air flowing in the outer region in air-intake duct 520) passes through air-supply ports 522*a* and then flows into frame body 414*a*. On the other hand, the air flowing in air-intake duct 520 passes through air-supply ports 522*b* and then flows into frame body 414*a*. As described above, the cross-sectional area of each air-supply port 522*a* is smaller than that of each air-supply port 522*b*. Therefore, the internal pressure partially increases at and around air-supply ports 522*a*, thus generating the air flow that tends to flow into frame body 414*a* from air-supply ports 522*b* disposed on the internal side where the internal pressure is low. As a result, as shown by the arrows in FIG. 4, the air guided to strip electrode 414*b* through a plurality of air-supply ports 522 (air-supply ports 522*a* and 522*b*) flows in the direction orthogonal to the longitudinal direction of strip electrode 414*b* or flows toward the center of strip electrode 414*b* in the longitudinal direction. Thus, the air containing the discharge products generated by the electrostatic discharge of strip electrode 414*b* smoothly flows toward air-intake port 532 of exhaust duct 530 without stagnating in frame body 414*a*, whereby the discharge products can be output without causing leakage. Therefore, it is possible to prevent discharge products from attaching to the surface of photoconductor drum 413, and to prevent image flow due to attachment of discharge products from occurring.

It is to be noted that the length from air-intake fan 510 to the end portion of air-intake duct 520 on strip electrode 414*b* side is preferably one-half or more of the length of strip electrode 414*b* in the longitudinal direction. One reason for this is to sufficiently expand, in the width direction of air-intake duct 520, the air output from air-intake fan 510 toward the bottom surface of air-intake duct 520.

In addition, as illustrated in FIG. 4, air-intake fan 510 is preferably disposed at a position that faces the center portion of the end portion of air-intake duct 520 on strip electrode 414*b* side, in the longitudinal direction of strip electrode 414*b*. One reason for this is to uniformly expand, in the width direction of air-intake duct 520, the air output from air-intake fan 510 toward the bottom surface of air-intake duct 520.

Figure 5:
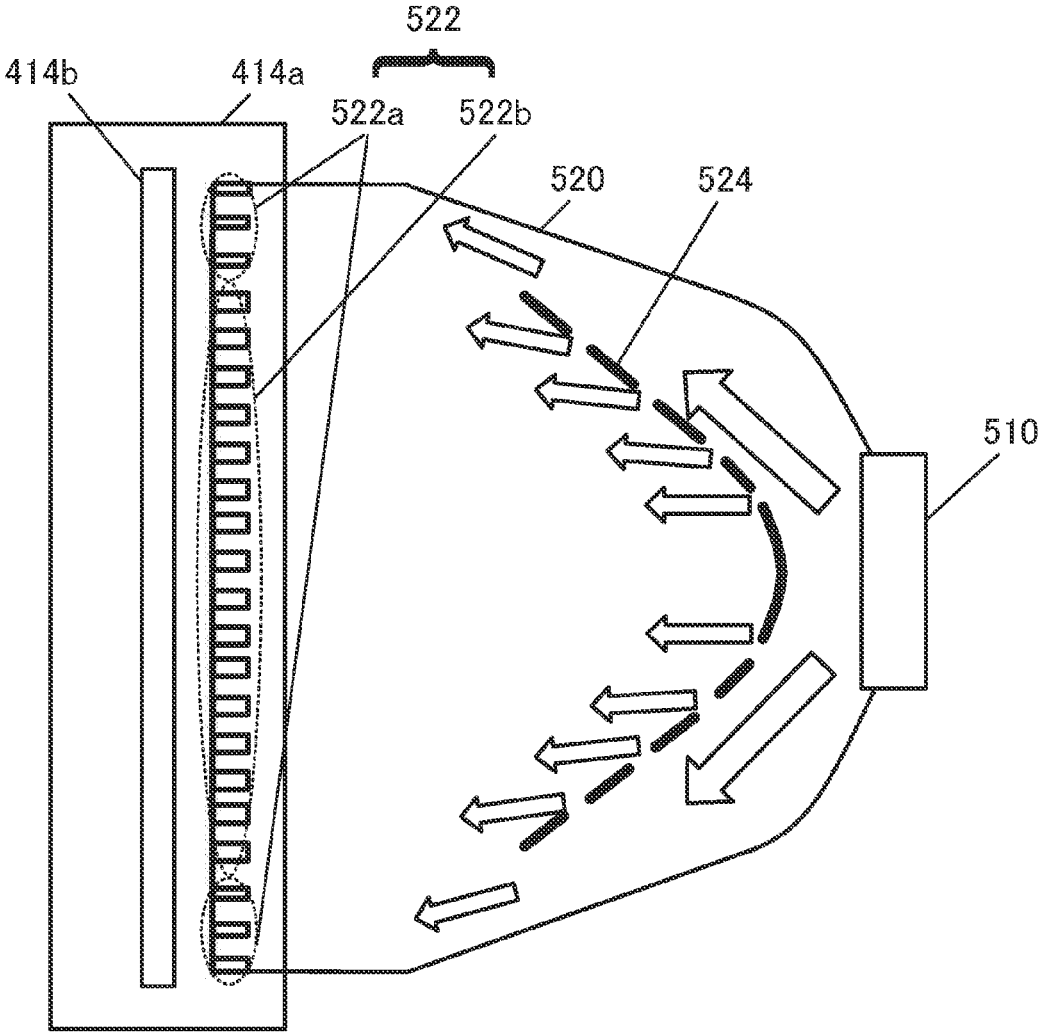
FIG. 5 illustrates a modification of the configuration of the charging unit of the present embodiment.

In addition, as illustrated in FIG. 5, air-intake duct 520 may be provided with flow adjusting member 524 that adjusts the air sucked by air-intake fan 510 such that the air expands toward the both sides in the longitudinal direction of strip electrode 414*b*. With this configuration, in comparison with the configuration illustrated in FIG. 4, the air output from air-intake fan 510 toward the bottom surface of air-intake duct 520 can be efficiently expanded in the width direction of air-intake duct 520 as shown by the arrows in the drawing.

Figure 6:
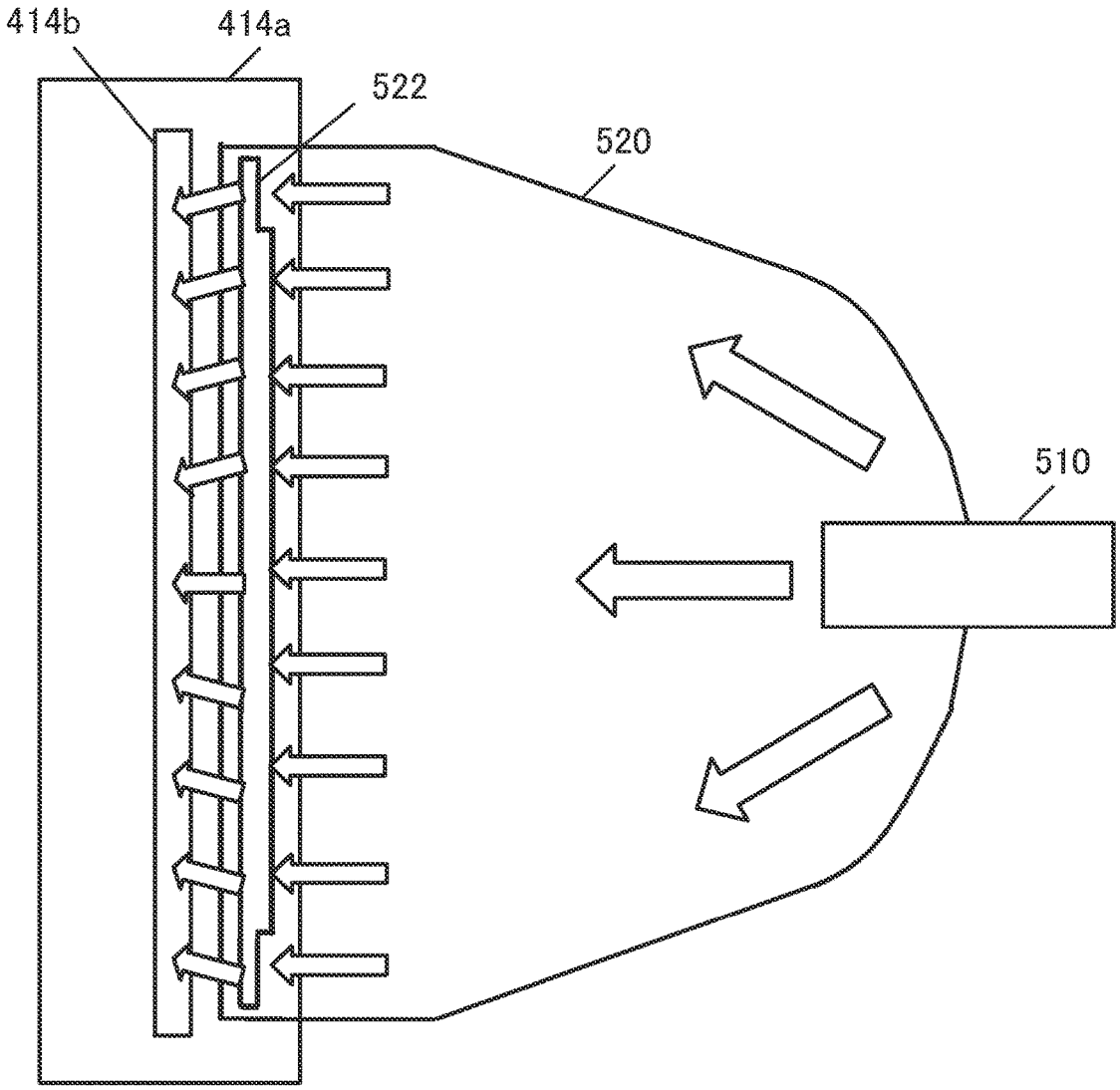
FIG. 6 illustrates a modification of the configuration of the charging unit of the present embodiment.
Figure 7:
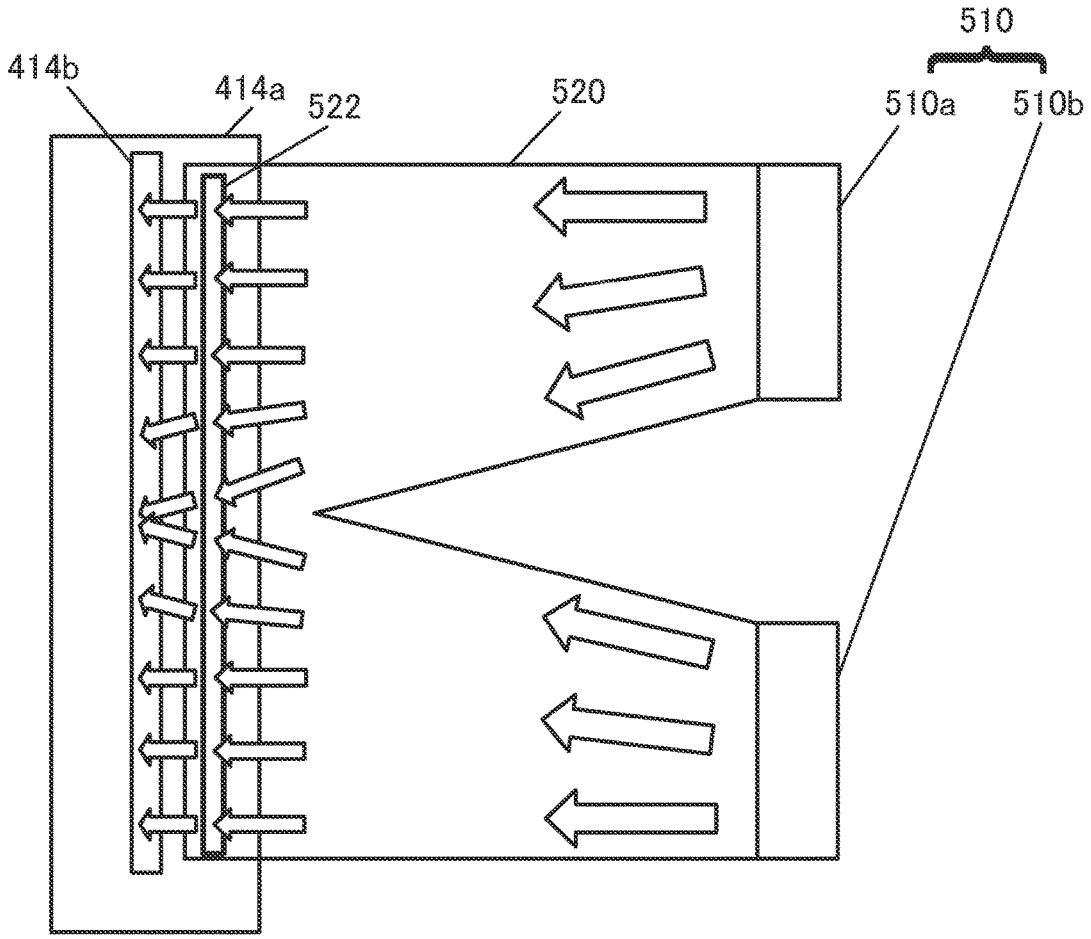
FIG. 7 illustrates a modification of the configuration of the charging unit of the present embodiment.

In addition, from the viewpoint of ensuring a smooth flow, toward air-intake port 532 of exhaust duct 530, of the air containing the discharge products generated by the electrostatic discharge of strip electrode 414*b*, air-intake duct 520 may have the configuration illustrated in FIG. 6 or 7 instead of the configuration illustrated in FIG. 4.

In the configuration illustrated in FIG. 6, air-intake duct 520 is formed in a flaring shape whose width gradually increases from air-intake fan 510 side toward strip electrode 414*b* side. At the end portion of air-intake duct 520 on strip electrode 414*b* side, air-supply port 522 is provided along the longitudinal direction of strip electrode 414*b*. In the longitudinal direction of strip electrode 414*b*, the cross-sectional area of the both end portions of air-supply port 522 is smaller than that of other portions of air-supply port 522.

The air output from air-intake fan 510 toward the bottom surface of air-intake duct 520 hits the bottom surface of air-intake duct 520, expands in the width direction of air-intake duct 520, and flows toward air-supply port 522 as shown by the arrows in the drawing. Thereafter, the air flowing in air-intake duct 520 passes through air-supply port 522 and flows into frame body 414*a*. As described above, since the cross-sectional area of the both end portions of air-supply port 522 is smaller than that of other portions of air-supply port 522 in the longitudinal direction of strip electrode 414*b*, the internal pressure partially increases at and around the both end portions of air-supply port 522, thus generating the air flow that tends to flow into frame body 414*a* from air-supply ports 522*b* on the inside where the internal pressure is low. As a result, as shown by the arrows in FIG. 5, air guided to strip electrode 414*b* through air-supply port 522 flows in the direction orthogonal to the longitudinal direction of strip electrode 414*b*, or flows toward the center of strip electrode 414*b* in the longitudinal direction. Thus, the air containing the discharge products generated by the electrostatic discharge of strip electrode 414*b* smoothly flows toward air-intake port 532 of exhaust duct 530 without stagnating in frame body 414*a*.

In the configuration illustrated in FIG. 7, air-intake duct 520 is formed in a pants-like shape in which air output from two air-intake fans 510 (510*a* and 510*b*) disposed on the both sides in the longitudinal direction of strip electrode 414*b* flows toward air-supply port 522. At the end portion of air-intake duct 520 on strip electrode 414*b* side, air-supply port 522 is provided along the longitudinal direction of strip electrode 414*b*. In the longitudinal direction of strip electrode 414*b*, the cross-sectional area of air-supply port 522 is constant. The air output from air-intake fan 510*a* flows along the shape of air-intake duct 520 as shown by the arrows in the drawing, and the direction of the air flow is not changed at the time when the air passes through air-supply port 522. In addition, the air output from air-intake fan 510*b* flows along the shape of air-intake duct 520 as shown by the arrows in the drawing, and the direction of the air flow does not change when the air passes through air-supply port 522. Thus, the air guided to strip electrode 414*b* through air-supply port 522 flows in the direction orthogonal to the longitudinal direction of strip electrode 414*b* or flows toward the center of strip electrode 414*b* in the longitudinal direction. Thus, the air containing the discharge products generated by the electrostatic discharge of strip electrode 414*b* smoothly flows toward air-intake port 532 of exhaust duct 530 without stagnating in frame body 414*a*. It is to be noted that, preferably, air-intake fans 510*a* and 510*b* are disposed in parallel to each other in the longitudinal direction of strip electrode 414*b* as illustrated in FIG. 7. One reason for this is to uniformize the flow of air output from air-intake fan 510*a* and the flow of air output from air-intake fan 510*b* in the longitudinal direction of strip electrode 414*b*, and in turn, to uniformize the flow of air guided to strip electrode 414*b* through air-supply port 522 between the both sides (the upper side relative to the center portion in the longitudinal direction of strip electrode 414*b*, and the lower side relative to the center portion in the longitudinal direction of strip electrode 414*b*).

[Effect of Present Embodiment]

As has been described in detail, in the present embodiment, an image forming apparatus includes: a charging section 414*b* configured to charge a surface of an image bearing member 413; an air-intake duct 520 having an air-supply port 522, and configured to guide air sucked from an outside to the charging section 414*b* through the air-supply port 522; an exhaust duct 530 having an air-intake port 532, and configured to suck air around the charging section 414*b* through the air-intake port 532 and eject the air thus sucked. The air-intake duct 520 has a configuration in which air guided to the charging section 414*b* through the air-supply port 522 flows in a direction orthogonal to a longitudinal direction of the charging section 414*b*, or flows toward a center of the charging section 414*b* in the longitudinal direction.

According to the above-mentioned configuration of the present embodiment, the air containing the discharge products generated by the electrostatic discharge of strip electrode 414*b* smoothly flows toward air-intake port 532 of exhaust duct 530, and the discharge products can be output without causing leakage. Therefore, it is possible to prevent discharge products from attaching to the surface of photoconductor drum 413, and to prevent image flow due to attachment of discharge products from occurring.

[Modification]

It is to be noted that, while charging device 414, air-intake duct 520 and exhaust duct 530 are separate components in the above-mentioned embodiment, charging device 414, air-intake duct 520 and exhaust duct 530 may be integrally provided. For example, strip electrode 414*b* may be composed as a part of air-intake duct 520 and exhaust duct 530 by casing strip electrode 414*b* with a resin or the like.

In addition, while strip electrode 414*b* functions as the charging section of the embodiment of the present invention in the above-mentioned embodiment, the present invention is not limited to this. For example, in place of strip electrode 414*b*, a charging wire, a charging roller, a charging brush or the like may be adopted as the charging section of the embodiment of the present invention. In addition, while non-contact type charging is performed in the above-mentioned embodiment, contact-type charging may also be adopted.

In addition, while the photoconductor is a cylindrical member in the above-mentioned embodiment, a belt-shaped photoconductor installed in a stretched state around a plurality of rollers or the like may also be employed.

In addition, while air-intake fan 510 and exhaust fan 540 respectively correspond to the air inlet part and the exhaust part of the embodiment of the present invention in the above-mentioned embodiment, the present invention is not limited to this. For example, in place of air-intake fan 510 and exhaust fan 540, a gas compressor (compressor) may also be employed. The air inlet part and the exhaust part are not limited as long as they can generate an air flow that sufficiently sweeps and sucks discharge products (ozone the like) from the space around strip electrode 414*b* in conjunction with each other.

Example

Finally, results of experiments performed by the present inventor for confirming the effectiveness of the above-mentioned embodiment will be described.

[Configuration of Image Forming Apparatus According to Example]

As the image forming apparatus according to an example, image forming apparatus 1 (charging unit 500) having the configuration illustrated in FIG. 1 to FIG. 4 was used.

[Configuration of Image Forming Apparatus According to Comparative Example]

Figure 8:
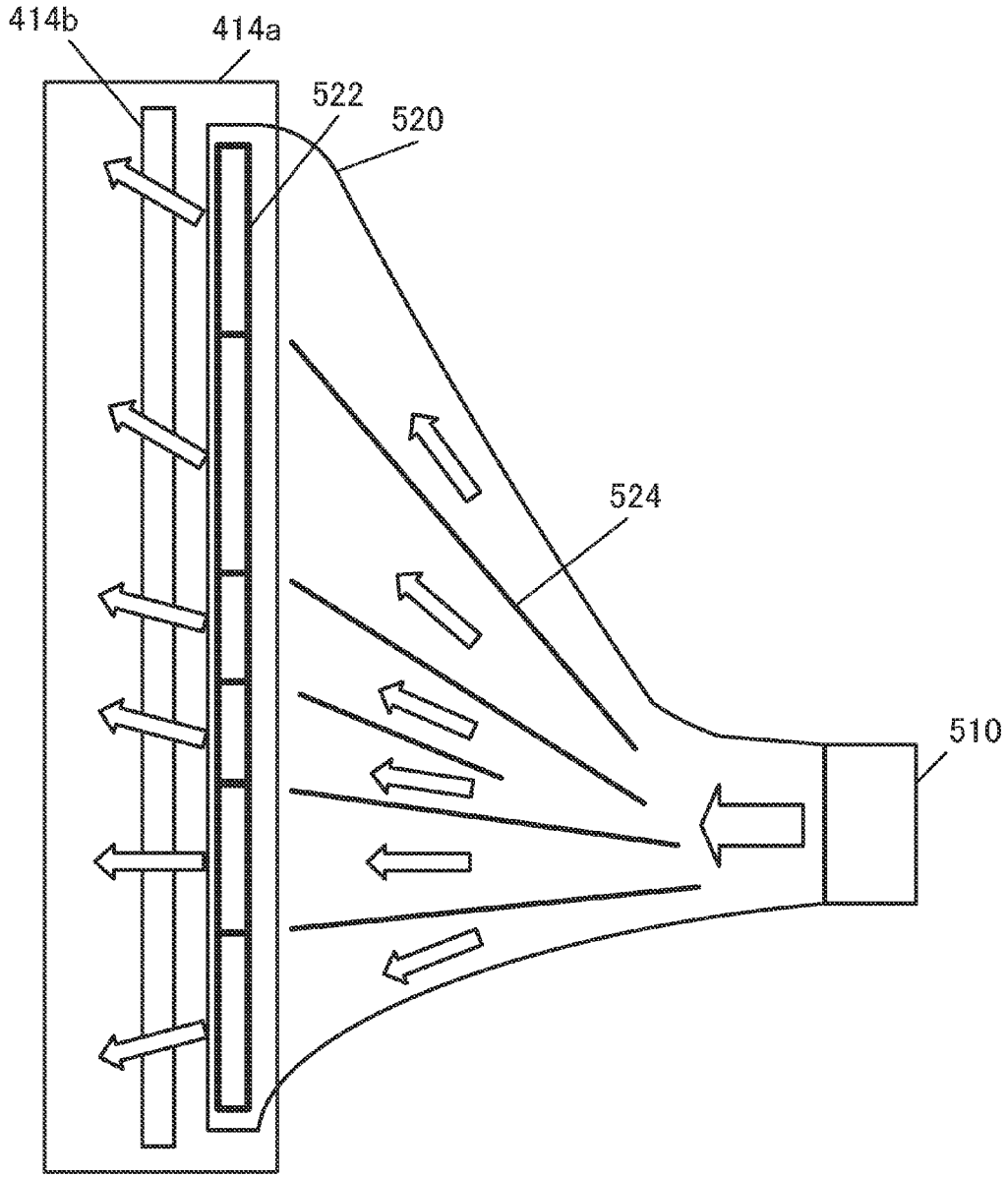
FIG. 8 illustrates a configuration of a charging unit of a comparative example.

As the image forming apparatus according to a comparative example, image forming apparatus 1 (charging unit 500) having the configuration illustrated in FIG. 1 to FIG. 3 and FIG. 8 was used. As illustrated in FIG. 8, air-intake duct 520 is formed in a flaring shape whose width gradually increases from air-intake fan 510 side toward strip electrode 414*b* side. In addition, in air-intake duct 520, a plurality of flow adjusting members 524 (flow adjusting plates) that adjust the air sucked by air-intake fan 510 such that the air sucked by air-intake fan 510 expands toward the both sides in the longitudinal direction of strip electrode 414*b* are provided. In addition, at the end portion of air-intake duct 520 on strip electrode 414*b* side, a plurality of air-supply ports 522 are provided such that air-supply ports 522 respectively face a plurality of channels partitioned by flow adjusting members 524 in the longitudinal direction of strip electrode 414*b* (in the drawing vertical direction). In the comparative example, as shown by the arrows in the drawing, the air sucked by air-intake fan 510 flows from air-intake duct 520 in such a manner as to expand toward the both sides in the longitudinal direction of strip electrode 414*b*. Therefore, the air that has passed through air-supply ports 522 does not smoothly flow toward air air-intake port 532 of exhaust duct 530.

[Experimental Method]

Figure 9:
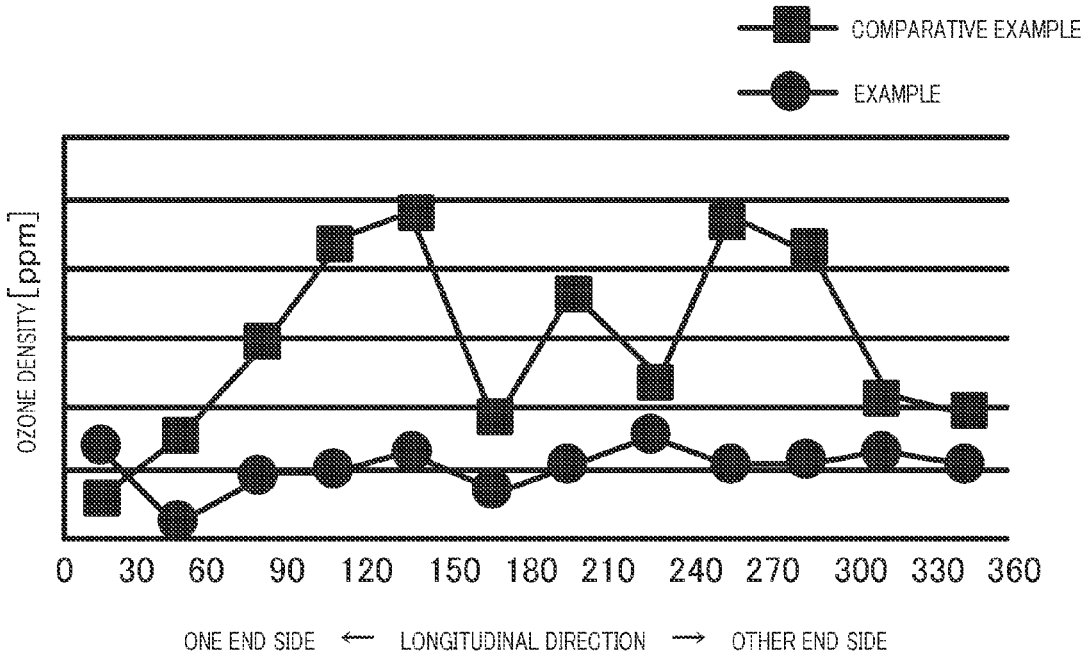
FIG. 9 shows results of an experiment in an example and a comparative example.

In this experiment, electrostatic discharge of strip electrode 414*b* was caused by supplying power to strip electrode 414*b*, with air-intake fan 510 and exhaust fan 540 being operated. At this time, an ozone density sensor was used to measure the ozone density [ppm] around strip electrode 414*b* (specifically, immediately below strip electrode 414*b*). FIG. 9 shows the ozone densities in the longitudinal direction of strip electrode 414*b* which were measured in the example and the comparative example.

[Results of Experiment]

As illustrated in FIG. 9, it was confirmed that the ozone density in the longitudinal direction of strip electrode 414*b* was significantly low in charging unit 500 according to the example, in comparison with charging unit 500 according to the comparative example. In the case of the comparative example, part of the air containing the discharge products generated by the electrostatic discharge of strip electrode 414*b* stagnated in frame body 414*a* and did not smoothly flow toward air-intake port 532, and consequently, it was impossible to output the discharge products without causing leakage. Accordingly, in the case of the comparative example, discharge products cannot be prevented from attaching on the surface of photoconductor drum 413, and image flow due to attachment of the discharge products cannot be prevented from occurring.

The invention claimed is:

1. An image forming apparatus comprising:

a charging section configured to charge a surface of an image bearing member;

an air-intake duct having a plurality of air-supply ports provided in a row along a longitudinal direction of the charging section, and configured to guide air sucked from an outside to the charging section through the air-supply ports;

an exhaust duct having an air-intake port, and configured to suck air around the charging section through the air-intake port and eject the air thus sucked, wherein the air-intake duct has a configuration in which air guided to the charging section through the air-supply ports flows in a direction orthogonal to the longitudinal direction of the charging section, or flows toward a center of the charging section in the longitudinal direction, in the longitudinal direction of the charging section, the air-intake duct has a width that gradually increases toward the charging section side, and the plurality of air-supply ports in the row includes a plurality of air-supply ports provided on each of both sides in the row in the longitudinal direction of the charging section and other air supply ports provided in regions other than the both sides in the row, each of the plurality of air-supply ports provided on the both sides having a cross-sectional area smaller than that of the other air supply ports provided in regions other than the both sides in the row.

2. The image forming apparatus according to claim 1, wherein the air-intake duct is provided with a flow adjusting member configured to adjust air sucked from an outside such that the air expands toward both sides in the longitudinal direction of the charging section.

3. The image forming apparatus according to claim 1, wherein the air-intake duct includes two air-intake fans provided on both sides in the longitudinal direction of the charging section.

4. The image forming apparatus according to claim 1, wherein the width of an end portion of the exhaust duct on a side facing the charging section is smaller than the width of an end portion of the air-intake duct on the charging section side facing the charging section.

5. A charging device comprising:

a charging section configured to charge a surface of an image bearing member;

an air-intake duct having a plurality of air-supply ports provided in a row along a longitudinal direction of the charging section, and configured to guide air sucked from an outside to the charging section through the air-supply ports;

an exhaust duct having an air-intake port, and configured to suck air around the charging section through the air-intake port and eject the air thus sucked, wherein the air-intake duct has a configuration in which air guided to the charging section through the air-supply ports flows in a direction orthogonal to the longitudinal direction of the charging section, or flows toward a center of the charging section in the longitudinal direction, in the longitudinal direction of the charging section, the air-intake duct has a width that gradually increases toward the charging section side, and the plurality of air-supply ports in the row includes a plurality of air-supply ports provided on each of both sides in the row in the longitudinal direction of the charging section and other air supply ports provided in regions other than the both sides of the row, each of the plurality of air-supply ports provided on the both sides of the row having a cross-sectional area smaller than that of the other air supply ports provided in regions other than the both sides of the row.

6. The charging device according to claim 5, wherein the air-intake duct is provided with a flow adjusting member configured to adjust air sucked from an outside such that the air expands toward both sides in the longitudinal direction of the charging section.

7. The charging device according to claim 5, wherein the air-intake duct includes two air-intake fans provided on both sides in the longitudinal direction of the charging section.

8. The charging device according to claim 5, wherein the width of an end portion of the exhaust duct on a side facing the charging section is smaller than the width of an end portion of the air-intake duct on the charging section side facing the charging section.

* * * * *